US006861604B2

(12) United States Patent
McSwiggen

(10) Patent No.: US 6,861,604 B2
(45) Date of Patent: Mar. 1, 2005

(54) PUSH BUTTON SWITCH

(75) Inventor: John P. McSwiggen, Bloomingdale, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 10/377,383

(22) Filed: Feb. 28, 2003

(65) Prior Publication Data

US 2004/0168899 A1 Sep. 2, 2004

(51) Int. Cl.[7] ..... H01H 13/14
(52) U.S. Cl. ..... 200/520; 200/546
(58) Field of Search ..... 200/517–536, 200/546, 564, 314, 342, 345

(56) References Cited

U.S. PATENT DOCUMENTS 4,385,219 A * 5/1983 Finlayson ..... 200/506
4,743,723 A 5/1988 Seabeck
5,004,880 A * 4/1991 Koutaka ..... 200/521
5,066,841 A 11/1991 Zoller et al.
5,803,242 A * 9/1998 Takano et al. ..... 200/530
6,441,332 B1 * 8/2002 Crawford et al. ..... 200/520

* cited by examiner

*Primary Examiner*—Elvin Enad
*Assistant Examiner*—Lisa Klaus
(74) *Attorney, Agent, or Firm*—Marshall, Gerstein & Borun LLP

(57) ABSTRACT

A push button switch is provided having a switch housing having at least two contacts wherein at least one of the contacts has an engagement surface. The switch includes a switch actuator having an actuation surface. The actuator is in communication with the housing and is adapted to be movable with respect to the housing when depressed. The actuation surface is adapted to engage the engagement surface of the at least one contact when the switch actuator is depressed. The two contacts are adapted to contact each other at an actuation point defined by the actuation surface of the switch actuator.

30 Claims, 3 Drawing Sheets

ACTUATION TRAVEL
OVER TRAVEL
A
B
10
12
14
14a
14B
14c
15
16
16a
16b
16c
18
19
20
22
24
25
26
28
29
30

PUSH BUTTON SWITCH

TECHNICAL FIELD

The present invention generally relates to electro-mechanical switches for microelectronic devices, and more particularly to a push button switch having over travel for use in hearing aids.

BACKGROUND OF THE INVENTION

Electro-mechanical switches have become extremely important to provide user control of various features and functions of electronic and micro-electronic devices, such as hearing aids. Push button switches are typically utilized in applications that require simple on/off functionality. Such switches can be normally open (i.e., actuation of the switch closes an associated circuit) or normally closed (i.e., actuation of the switch opens an associated circuit). While push button switches are utilized in simple on/off applications, their implementation and design are not always simple.

Push button switches typically have an actuator, driver, or plunger of some type that is situated within a switch housing having at least two contacts in communication with an electrical circuit within which the switch is incorporated. A user can depress the plunger to actuate the switch by either causing the contacts to make contact with each other (normally open switch) or break contact with each other (normally closed switch). An actuation point is defined as the point where the switch causes the contacts to either first contact each other or first break contact with each other. Because of manufacturing and assembly tolerances, this actuation point can vary from switch to switch. To address the effects of assembly tolerances, as well as issues concerning user "feel" of the switch, push button switches are typically designed with an over-travel component, wherein the plunger is allowed to travel past the actuation point. Thus, a user is allowed to continue to depress the plunger even after the switch is actuated.

One known push button switch having an over-travel mechanism includes a pair of springs disposed on an axis of the plunger. The first spring appears to provide the bias force against which the plunger is depressed. The actuator is depressed when the actuation force overcomes the spring force of this first spring. Once the switch is actuated, the second spring appears to compress and provide the over-travel component. One problem with this configuration is the dependence on the spring constants. A small change in either spring may result in the elimination of the over-travel component.

Other problems associated with known push button switches having over-travel components and actuation points include lack of control in defining the point of actuation and the amount of over travel, as well as a general lack of robustness and reliability in their designs such that the switches can withstand repeated use.

The present invention is provided to solve these and other problems.

SUMMARY OF THE INVENTION

A push button switch is provided having a switch housing having at least two contacts wherein at least one of the contacts has an engagement surface. The switch includes a switch actuator having an actuation surface. The actuator is in communication with the housing and is adapted to be movable with respect to the housing when depressed. The actuation surface is adapted to engage the engagement surface of the at least one contact when the switch actuator is depressed. The two contacts are adapted to contact each other at an actuation point defined by the actuation surface of the switch actuator.

DETAILED DESCRIPTION OF THE PREFERRED EMBODIMENT

Figures 1, 2, 3:
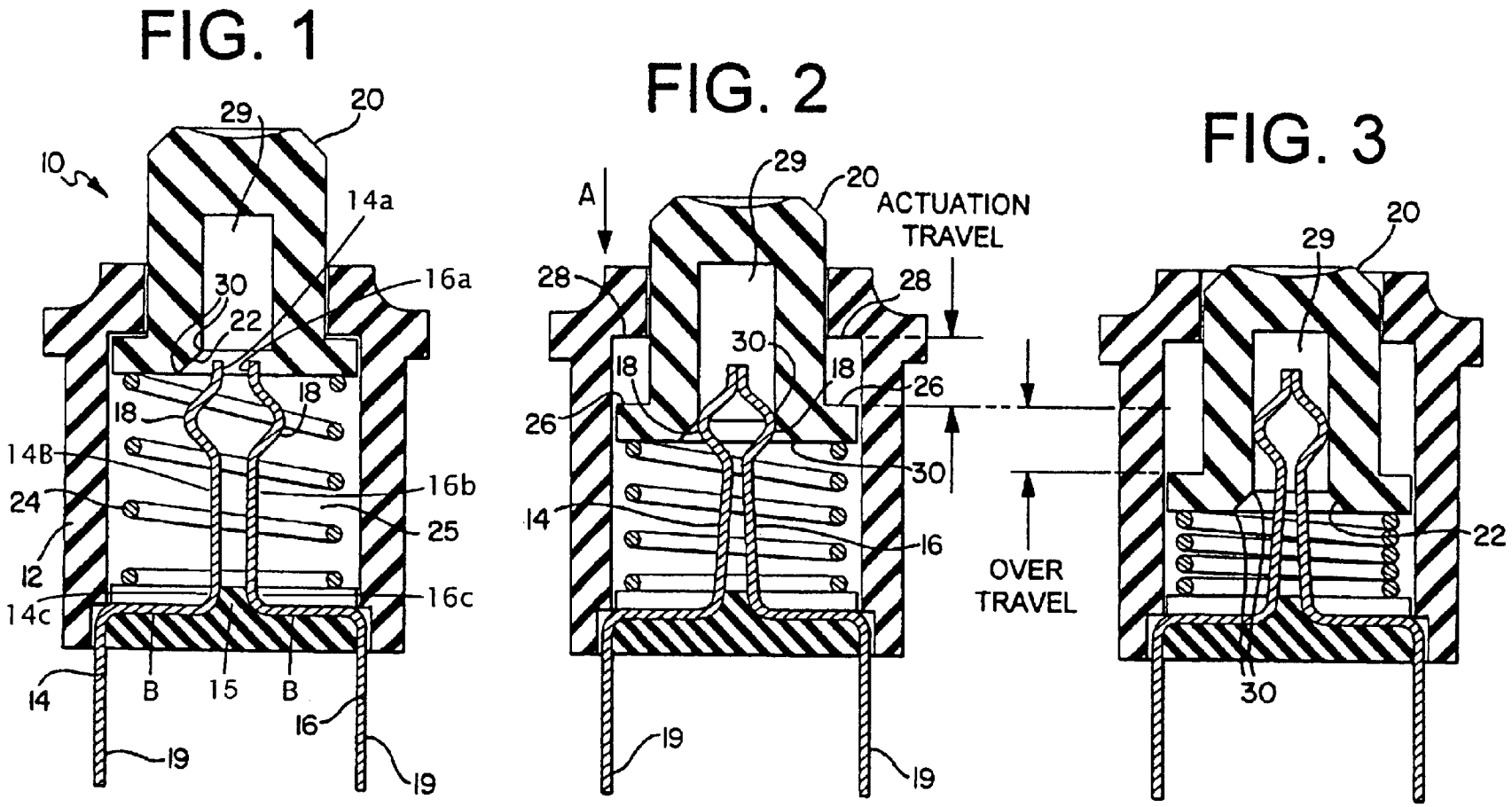
FIG. 1 is a cross-sectional view in elevation of a first embodiment of a push button switch in accordance with the present invention.
FIG. 2 is a cross-sectional view in elevation of the push button switch depicted in FIG. 1 showing an actuator of the switch in an actuated position.
FIG. 3 is a cross-sectional view in elevation of the push button switch depicted in FIG. 1 showing the actuator in a fully depressed position and a resultant over-travel of the actuator.

While the present invention will be described fully hereinafter with reference to the accompanying drawings, in which one or more particular embodiments are shown, it is to be understood at the outset that persons skilled in the art may modify the invention herein described while still achieving the desired result of this invention. Accordingly, the description that follows is to be understood as a broad informative disclosure directed to persons skilled in the appropriate arts and not as limitations of the present invention.

For purposes of simplifying the description of the various embodiments herein, similar elements amongst the various embodiments share the same reference numerals. For purposes of further simplification, elements that have been previously described in connection with other embodiment (s) may not necessarily be described with respect to each of the embodiments described herein, with the understanding that the description and drawings, taken as a whole, enables one of ordinary skill in the art to practice the invention as claimed in the accompanying claims.

FIGS. 1–3 depict a cross-section of a push button switch 10 in accordance with the present invention. The switch 10 includes a switch housing 12 having at least two contacts 14 and 16, at least one of which includes an engagement surface 18. In the embodiment shown in FIGS. 1–3, both of the contacts 14 and 16 include an engagement surface 18. The contacts 14 and 16 are in a normally open position, as shown in FIG. 1. Each of the contacts 14 and 16 include a terminal end 19 that extends from the housing 12 to allow connectivity within an electrical circuit. The switch 10 also includes a switch actuator 20 having at least one angled actuation surface 22. The switch actuator 20 is in communication with the housing 12 and is adapted to be moveable with respect to the housing 12 when depressed. A spring 24 is disposed within an inner portion 25 of the housing 12 and acts to bias the actuator 20 in a neutral unactuated position as shown in FIG. 1. As shown in FIG. 2, the switch actuator 20 includes a shoulder 26 that acts as a stop against a top portion 28 of the housing 12. The spring 24 urges the shoulder 26 into contact with the top portion 28 of the housing 12.

The contacts 14 and 16, as illustrated in the exemplary embodiment of FIG. 1, are each integrally formed from a contiguous piece of flexible material. The contacts 14 and 16 each include an electrical contact 14*a* and 16*a*, respectively, formed adjacent to the engagement surfaces 18. Flexible vertical portions 14*b* and 16*b* support and align the engagement surfaces 18 and the electrical contacts 14*a* and 16*a* in a parallel orientation. The flexible vertical portions 14*b* and 16*b* transition to a base B at a flexure point 14*c* and 16*c*, respectively. The flexure points 14*c* and 16*c* abut a flexure restraint 15 arranged to limit movement of the flexible vertical portions 14*b* and 16*b* and the corresponding flexure point 14*c* and 16*c*. In operation the flexure point 14*c* and 16*c* allow the electrical contacts 14*a* and 16*a* to form an electrically conductive path when the vertical portions 14*b* and 16*b* and the respective engagement surface 18 are flexed towards each other and against the flexure restraint, as shown in FIG. 2.

As shown in FIG. 1, the actuation surface 22 is a chamfer formed at an opening of an inner cavity 29 of the switch actuator 20. The chamfer defines two edges 30, which, in turn, define the angled actuation surface 22 therebetween. The slope of the angled actuation surface 22 controls the position of the actuation point, i.e., the position of the actuator 20 where the contacts 14 and 16 contact each other. FIG. 2 shows the actuation travel of the actuator 20, i.e., the travel of the actuator 20 required to reach the actuation point. Thus, the actuation point of the switch 10 can be changed by changing the slope of the actuation surface 22. The steeper the slope of the actuation surface 22, the further the actuator 20 must travel before it reaches the actuation point.

Referring to FIG. 3, the actuation surface 22, which defines the actuation point, also defines a resultant over-travel of the actuator 20. The over-travel is defined as a distance the actuator 20 is allowed to continue traveling after the actuation point is reached. Thus, as the actuation point is changed, the resultant over-travel is also changed. As shown in FIG. 3, the contacts 14 and 16 are allowed to move within the inner cavity 29 of the switch actuator 20 after the engagement surfaces 18 of the contacts 14 and 16 pass the actuation surface 22 of the actuator 20. A comparison of FIGS. 2 and 3 shows the resultant over travel for the actuator 20.

Figure 4:
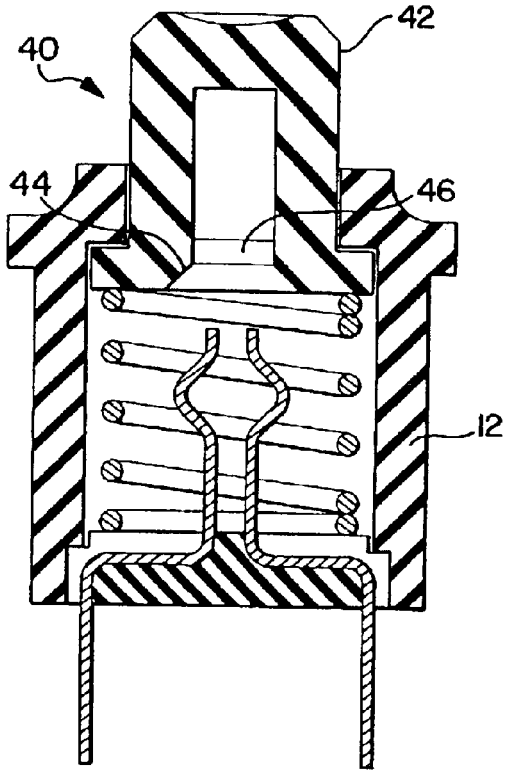
FIG. 4 is a cross-sectional view in elevation of a second embodiment of a push button switch in accordance with the present invention.

FIG. 4 depicts a second embodiment push button switch 40. In this embodiment, the switch 40 includes a switch actuator 42 having a first actuator surface 44 defining a first actuation point and a second actuator surface 46 defining a second actuation point. The switch actuator 42 is adapted to allow selectability between the two actuation points. In this embodiment, the switch actuator 42 is rotatable with respect to the housing 12 to allow selectability between the two actuation surfaces 44 and 46, thereby allowing selectability between the two actuation points each defined by one of the actuation surfaces 44 and 46.

Figure 5:
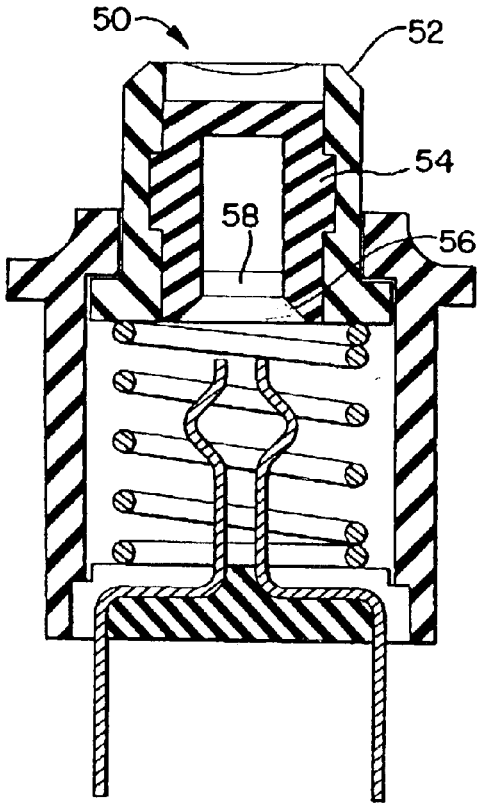
FIG. 5 is a cross-sectional view in elevation of a third embodiment of a push button switch in accordance with the present invention.
Figure 6:
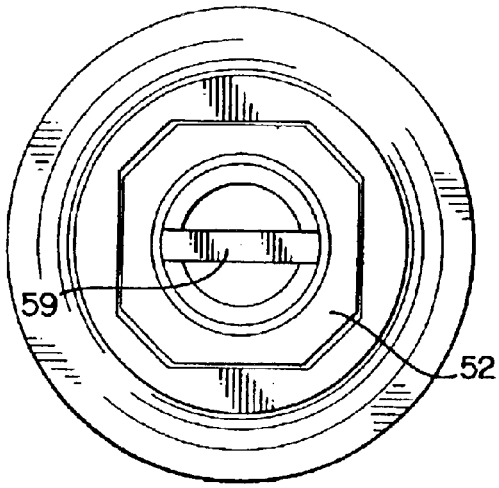
FIG. 6 is a top plan view of the switch depicted in cross-section in FIG. 5.

In yet another embodiment shown in FIGS. 5 and 6, a push button switch 50 is provided wherein a switch actuator 52 includes a sleeve 54 that is rotatable with respect to the actuator 52 to allow selectability between a first actuation surface 56 and a second actuator surface 58. As shown in FIG. 6, the sleeve 54 includes a slot 59 adapted to accommodate a tool (not shown), such as a screwdriver, to facilitate rotation of the sleeve 54 with respect to the actuator 52. As shown in FIG. 5, the sleeve 54 is axially held in place within the inner cavity of the actuator 52 and allowed to rotate with respect thereto. The combination of the sleeve 54 and the actuator 52 can be formed by an over-molding process. The sleeve 54 may also engage the actuator 52 via a threaded engagement. This type of engagement would allow the sleeve 54 to be removed, thereby allowing interchangeability between the actuator 52 and the sleeve 54 to facilitate various desired actuation points.

Figure 7:
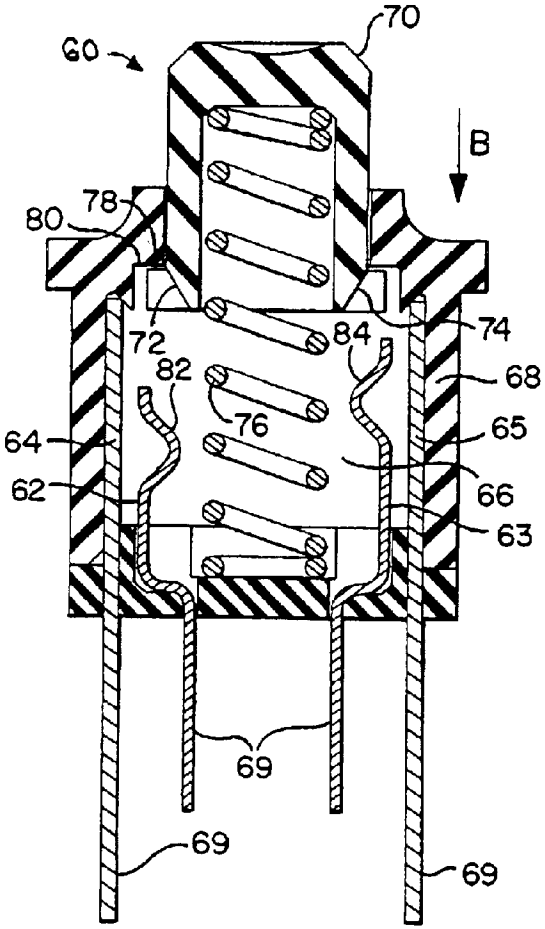
FIG. 7 is a cross-sectional view in elevation of a fourth embodiment of a push button switch in accordance with the present invention.

The principles of the present invention can also be applied in a double pole switch having either normally open or normally closed contacts. Referring to FIG. 7, a double pole push button switch 60 is provided in accordance with the principles of the present invention. The switch 60 includes a set of movable contacts 62 and 63, and a set of stationary contacts 64 and 65 disposed within an inner portion 66 of a housing 68. Each of the contacts 62, 63, 64 and 65 include a terminal end 69 that extends from the housing 68 to allow connectivity within an electrical circuit. The switch 60 also includes a switch actuator 70 having a first chamfer, or angled actuation surface 72, and a second chamfer, or angled actuator surface 74. The actuator 70 is in communication with the housing 68 and is adapted to be moveable with respect to the housing 68 when depressed. A spring 76 is disposed within the inner portion 66 of the housing 68 and acts to bias the actuator 70 in a neutral unactuated position as shown in FIG. 7. The actuator 70 includes a shoulder 78 that acts as a stop against a top portion 80 of the housing 68. The spring 76 urges the shoulder of the actuator into contact with the top portion 80 of the housing 68.

Referring again to FIG. 7, the moveable contact 62 includes an engagement surface 82 and the moveable contact 63 includes an engagement surface 84. The engagement surface 84 of the moveable contact 63 is positioned within the inner portion 66 of the housing 68 such that as the actuator 70 is depressed (in a direction indicated by arrow B), it will contact the actuation surface 74 of the actuator 70 prior to contact between the engagement surface 82 of the moveable contact 62 and the actuation surface 72 of the actuator 70. As the actuator 70 travels in the direction indicated by arrow B, the actuation surface 74 makes contact with the engagement surface 84 of the moveable contact 63 at an engagement position and urges the moveable contact 63 toward the stationary contact 65. The moveable contact 63 eventually makes contact with the stationary contact 65 at a first actuation point. Similarly, as the actuator 70 travels in the direction indicated by arrow B, the actuation surface 72 eventually makes contact with the engagement surface 82 of the moveable contact 62 at an engagement position and urges the moveable contact 62 toward the stationary contact 64. This occurs after contact is made between the engagement surface 84 of the moveable contact 63 and the actuation surface 74. The moveable contact 62 eventually makes contact with the stationary contact 64 at an actuation point. This occurs after the moveable contact 63 makes contact with the stationary contact 65 at the first actuation point. Thus, the switch 60 provides a double pole push button switch having normally open contacts.

As with the previously described embodiments, the actuation points of the switch 70 can be changed by changing the slope of the actuation surfaces 72 and 74. The steeper the slope of the actuation surfaces 72 and 74, the further the actuator 70 must travel before it reaches the actuation points. Although not shown for this particular embodiment, a second set of actuation surfaces could be incorporated into the actuator to allow selectability between sets of actuation points for the switch 70, similar to the actuators of the embodiments depicted in FIGS. 4 and 5.

Similar to the previously described embodiments, the actuation surface 72, which defines the actuation point between the moveable contact 62 and the stationary contact 64, also defines a resultant over-travel. The over-travel for this switch is defined as a distance the actuator is allowed to continue traveling after the second actuation point is reached. Thus, as this actuation point is changed, the resultant over-travel is also changed.

Figure 8:
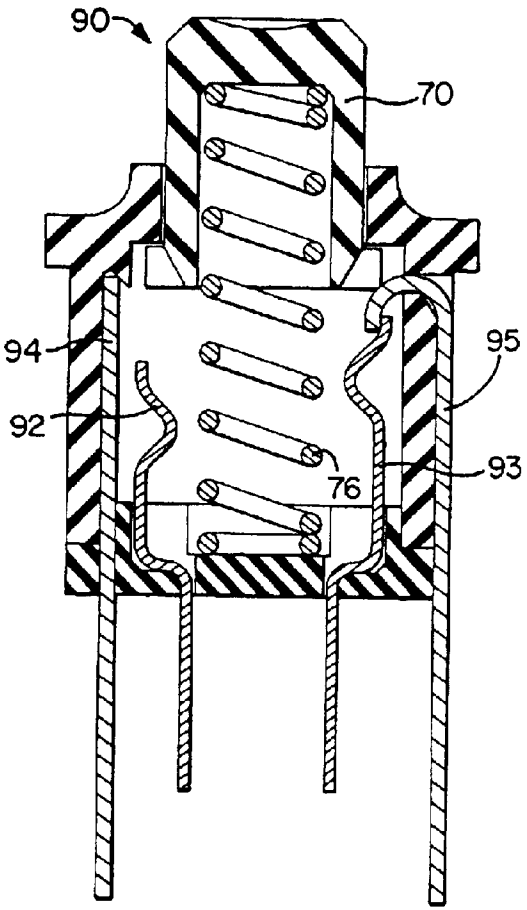
FIG. 8 is a cross-sectional view in elevation of a fifth embodiment of a push button switch in accordance with the present invention.

FIG. 8 depicts a push button switch 90, which is another embodiment of a double pole switch. In this embodiment, the switch 90 includes a set of moveable contacts 92 and 93, and a set of stationary contacts 94 and 95. This embodiment is substantially similar to the embodiment depicted in FIG. 7, with the exception that the stationary contact 95 is in contact with the moveable contact 93 when the actuator 70 is fully-biased by the spring 76 in a neutral unactuated position as shown in FIG. 8. Thus, the switch 90 provides a double pole push button switch having a set of normally open contacts (92 and 94) and a set of normally closed contacts (93 and 95).

Figure 9:
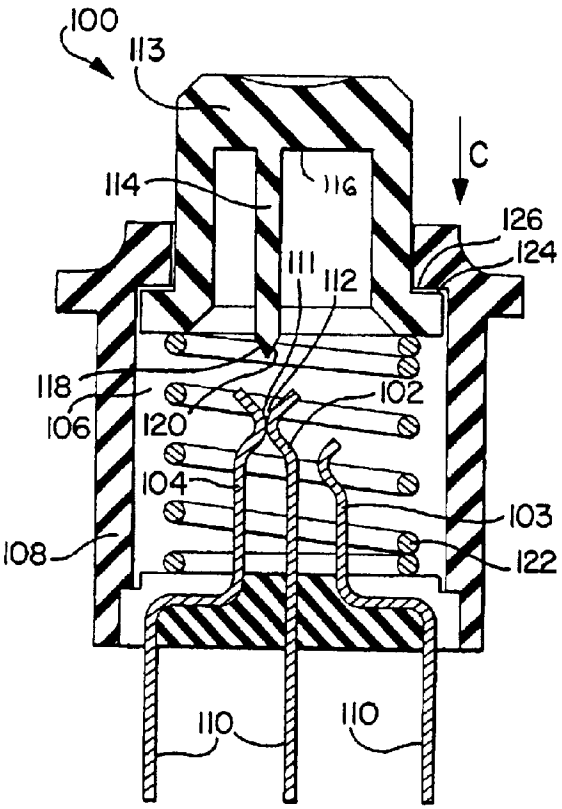
FIG. 9 is a cross-sectional view in elevation of a sixth embodiment of a push button switch in accordance with the present invention.

FIG. 9 depicts a push button switch 100, which is another embodiment of a double pole switch. In this embodiment, the switch 100 includes a first contact 102, a second contact 103 and an additional contact 104 disposed within an inner portion 106 of a housing 108. Each of the contacts 102, 103 and 104 include a terminal end 110 that extends from the housing 108 to allow connectivity within an electrical circuit. The first contact 102 and the additional contact 104 each have an engagement surface 111 and 112, respectively. The first and second contacts 102 and 103 are arranged to be in a normally open position. The first contact and the additional contact 104 are arranged to be in a normally closed position.

The switch 100 also includes a switch actuator 113 having a protrusion 114 that extends from an inner surface 116 of the switch actuator 113, as shown in FIG. 9. The protrusion 114 includes a first chamfer, or angled actuation surface 118 and a second chamfer, or angled actuation surface 120. The switch actuator 113 is in communication with the housing 108 and is adapted to be moveable with respect to the housing 108 when depressed. A spring 122 is disposed within the inner portion 106 of the housing 108 and acts to bias the actuator 113 in a neutral unactuated position as shown in FIG. 9. The switch actuator includes a shoulder 124 that acts as a stop against a top portion 126 of the housing 108. The spring 122 urges the shoulder of the actuator into contact with the top portion 126 of the housing 108.

As shown in FIG. 9, the first contact 102 and the additional contact 104 are in contact with each other when the actuator 113 is in the neutral unactuated position. As the switch actuator 113 is depressed by a user, the actuator 113 travels in a direction toward the contacts 103 and 104 as indicated by arrow C in FIG. 9, and eventually the protrusion 114 of the actuator 113 makes contact with at least one of the contacts 102 and 104. In the embodiment depicted in FIG. 9, the protrusion 114 of the actuator 113 makes contact with both of the contacts 102 and 104. The actuation surfaces 118 and 120 of the switch actuator 113 are adapted to engage the engagement surfaces 111 and 112 of the contacts 102 and 104, respectively, when the switch actuator 113 is depressed to an engagement position. As the actuator 113 is depressed, the first contact 102 and the additional contact 104 break contact, defining a first actuation point, and the first contact 102 is urged toward the second contact 103. Eventually, if the actuator 113 is depressed further, the first contact 102 and the second contact 103 contact each other at a second actuation point. Thus, the switch 100 provides a double pole push button switch having both normally open contacts and normally closed contacts, while utilizing only three contacts.

While the specific embodiments have been illustrated and described, numerous modifications may come to mind without significantly departing from the spirit of the invention, and the scope of protection is only limited by the scope of the accompanying claims.

What is claimed is:

1. A push button switch comprising:

a switch housing having at least two contacts, at least one of the contacts having an engagement surface and a flexure point;

a flexure restraint formed to abut the flexure point and resist the movement of the at least two contacts; and a switch actuator having an actuation surface, the switch actuator in communication with the switch housing and movable with respect to the switch housing when depressed;

the actuation surface engages the engagement surface of one of the at least two contacts when the switch actuator is depressed;

the at least two contacts are arranged to directly contact each other at an actuation point defined by the actuation surface of the switch actuator.

2. The push button switch of claim 1, further including a spring that biases the actuator away from the contacts.

3. The push button switch of claim 1, wherein the actuation surface comprises a chamfer disposed on the switch actuator.

4. The push button switch of claim 3, wherein the chamfer has two edges defining an angled surface therebetween.

5. The push button switch of claim 4, wherein an angle defined by the angled surface defines the actuation point.

6. The push button switch of claim 4, wherein an angle defined by the angled surface defines an over-travel of the switch.

7. The push button switch of claim 1, wherein the switch actuator and switch housing cooperate to allow the switch actuator to continue to move with respect to the housing beyond the actuation point.

8. A push button switch comprising:

a switch housing including at least two contracts having at least a portion disposed within an interior portion of the switch housing, one of the at least two of the contacts having an engagement surface and a flexure point, the switch housing further including a flexure restraint formed to abut the flexure point and resist the movement of the at least two contacts; and a switch actuator having a chamfered portion defining an actuation surface, the actuator having at least a portion moveably disposed within the housing;

the actuation surface defining an engagement point wherein the actuation surface and the engagement surface of one of the at least two contracts first engage each other as the switch actuator is depressed;

the actuation surface also defining an actuation paint wherein the at least two contracts directly contact each other as the switch actuator causes one of the at least two contacts to move toward the other contract as the switch actuator moves toward the contacts.

9. The push button switch of claim 8, further including a spring that biases the actuator away from the contacts.

10. The push button switch of claim 9, wherein the chamfered portion has two edges defining an angled surface therebetween.

11. The push button switch of claim 10, wherein an angle defined by the angled surface defines the actuation point.

12. The push button switch of claim 11, wherein the angle defined by the angled surface defines a resultant over-travel of the switch.

13. A push button switch comprising:

a switch housing having at least two contracts disposed therein, wherein one of the at least two contacts has an engagement surface and a flexure point;

a flexure restraint formed to abut the flexure point and resist the movement of the at least two contacts; and a switch actuator having an actuation surface, the switch actuator coupled to the switch housing and movable with respect to the switch housing when depressed;

the actuation surface engages the engagement surface of one of the at least two contacts as the switch actuator is depressed;

wherein the at least two contacts directly contact each other when the engagement surface of one of the at least two contacts reaches an actuation point defined by the actuation surface of the switch actuator.

14. The push button switch of claim 13, further including a spring that biases the actuation surface away from the engagement surface of the at least one contact.

15. The push button switch of claim 13, wherein the actuation surface comprises a chamfer disposed on the switch actuator.

16. The push button switch of claim 15, wherein the chamfer has two edges defining an angled surface therebetween.

17. The push button switch of claim 16, wherein an angle defined by the angled surface defines the actuation point and a resultant over-travel of the switch.

18. A push button switch comprising:

a switch housing including a first and second contacts, each having an engagement surface, a flexure point and a contact surface, the switch housing further including a flexure restraint formed to abut the flexure point and resist the movement of the at least two contacts; and a switch actuator slideably engaging the switch housing and shiftable between an at-rest position and a depressed position, the switch actuator including an actuation surface arranged to engage the engagement surface;

wherein the contact surface of the first contact directly engages the contact surface of the second contact when the actuation surface cooperates with the engagement surfaces of the first and second contacts as the switch actuator shifts from the at-rest position to the depressed position.

19. The push button switch of claim 18 further includes a spring that biases the actuation surface away from the engagement surfaces of the first and second contacts.

20. The push button of claim 18, wherein the actuation surface comprises a chamfer disposed within the switch actuator.

21. The push button switch of claim 18, wherein the actuation surface includes an angled surface arranged to cooperate with the engagement surface of the first and second contacts to define an actuation point.

22. The push button switch of claim 18, wherein an angle defined by the actuation surface defines an over-travel of the switch.

23. A push button switch comprising:

a switch housing sildeably cooperating with a switch actuator having an angled actuation surface;

a first contact having a first engagement surface and a first flexure point, wherein the first contact is disposed within the switch actuator;

a second contact having a second engagement surface and a second flexure point, wherein the second contact is disposed within the switch actuator and arranged opposite to the first contact;

wherein the first contact and the second contact are forced into direct communication with each other by the slideable cooperation of the angled actuation surface and the first and second engagement surfaces, and wherein a flexure restraint formed to abut the first and second flexure points and resist the direct communication of the first contact and the second contact.

24. The push button switch of claim 23 further includes a spring that biases the angled actuation surface away from the first and second engagement surfaces.

25. The push button switch of claim 23, wherein the actuation surface comprises a chamfer disposed within the switch actuator.

26. The push button switch of claim 23, wherein an angle defined by the angled actuation surface defines an actuation point.

27. A push button switch including a switch housing, the push button switch comprising:

a switch actuator slideably engaging the switch housing, the switch actuator including an inner cavity forming an actuation surface;

a first contact having a flexure point and an engagement surface arranged to cooperate with the actuation surface as the switch actuator slides relative to the switch housing;

wherein the first contact directly engages a second contact to form an electrical communications path, and a flexure restraint cooperates with the flexure point to resist the direct engagement of the first contact and the second contact.

28. The push button switch of claim 27 further includes a spring that biases the actuation surface away from the engagement surface of the first contact.

29. The push button switch of claim 27, wherein the actuation surface comprises a chamfer disposed within the switch actuator.

30. The push button switch of claim 27, wherein the actuation surface includes an angled surface arranged to cooperate with the engagement surface to define an actuation point.

* * * * *

UNITED STATES PATENT AND TRADEMARK OFFICE

CERTIFICATE OF CORRECTION

PATENT NO. : 6,861,604 B2
DATED : March 1, 2005
INVENTOR(S) : John P. McSwiggen

It is certified that error appears in the above-identified patent and that said Letters Patent is hereby corrected as shown below:

Column 8,
Line 12, please delete “sildeably” and insert -- slideably --.

Signed and Sealed this

Sixteenth Day of August, 2005

JON W. DUDAS
*Director of the United States Patent and Trademark Office*